United States Patent [19]

McCray

[11] Patent Number: 4,519,584

[45] Date of Patent: May 28, 1985

[54] FENCE POST DRIVER

[76] Inventor: William R. McCray, 917 W. Wade, El Reno, Okla. 73036

[21] Appl. No.: 485,314

[22] Filed: Apr. 15, 1983

[51] Int. Cl.[3] ..... E21B 19/00

[52] U.S. Cl. ..... 254/29 R

[58] Field of Search ..... 254/29 R, 30, 31, 132

[56] References Cited

U.S. PATENT DOCUMENTS

| | | | |
|---|---|---|---|
| 83,687 | 11/1868 | Borgort . | |
| 759,412 | 5/1904 | Beane . | |
| 2,244,899 | 6/1941 | Smith . | |
| 2,456,852 | 12/1948 | Anderson . | |
| 2,551,896 | 5/1951 | Notestein . | |
| 2,636,092 | 4/1953 | Lindquist | 254/29 R |
| 2,645,453 | 7/1953 | Nelson . | |
| 2,657,010 | 10/1953 | Sabin et al. . | |
| 2,742,258 | 4/1956 | Rosasco . | |
| 2,888,245 | 5/1959 | Anderson . | |
| 2,901,215 | 8/1959 | Jones | 254/29 R |
| 3,338,558 | 8/1967 | Gostomski . | |
| 3,365,952 | 1/1968 | Wang | 254/29 R |
| 3,902,326 | 9/1975 | Langenbach | 254/29 R |
| 3,910,556 | 10/1975 | Tiede | 254/29 R |
| 4,258,905 | 4/1981 | Brabander . | |

*Primary Examiner*—Robert C. Watson

*Attorney, Agent, or Firm*—Alan T. McCollom

[57] ABSTRACT

An apparatus for driving fence posts. An inner pipe is received within an outer pipe for coaxial sliding relative thereto. The outer pipe is mounted on a vehicle in a substantially upright position. A cable is journaled over a pulley mounted on the top of the inner pipe. One end of the cable is fixed to the outer pipe while the other end is wound on a winch mounted on a platform attached to the outer pipe. A spring biases the inner pipe upwardly in order to maintain the journaled engagement of the cable and the pulley. When the winch is turned on, the inner pipe is forced downwardly thus driving into the ground a fence post positioned within said outer pipe beneath said inner pipe.

8 Claims, 2 Drawing Figures

FENCE POST DRIVER

BACKGROUND AND SUMMARY OF THE INVENTION

The instant invention relates to fence post drivers and more particularly, to such drivers which are mountable on a vehicle.

Several past fence post drivers have been proposed, some of which are adapted for mounting on a vehicle. Such past drivers are typically mounted on the rear of a tractor or on the side of a truck. Past drivers typically include a head which is driven downwardly against the top of a fence post thus driving it into the ground. The head may be driven by, e.g., a power take-off on a tractor, movement of a three-point tractor hitch, or movement of the bed of a dump truck.

Such past drivers suffer from several deficiencies. One problem which presents itself is that the force applied to the driving head for driving the fence post is not applied along the axis of the post itself. Thus, a moment is created about the top of the fence post which tends to induce wobbling or variation in the angle of the post with respect to the ground as it is driven. This situation also stresses the apparatus itself more so than if the force were applied along the axis of the post and, a greater amount of force is required to drive the post when not applied along the axis thereof.

Another problem encountered in the use of such past apparatus relates to structure or lack thereof for bracing and aligning the post during the driving process. Often, the driving head provides the only contact between the apparatus and the fence post. In some cases, a flat surface may be adjacent one side of the fence post as it is driven downwardly. This lack of bracing of the post during driving coupled with the moment created about the top of the head of the post creates a great deal of instability in both the post and the apparatus during the driving process, thus increasing the potential for an accident and/or a crooked fence post.

The instant invention includes a tubular member adapted to be mounted in a generally upright position on the rear of a vehicle. An inner cylindrical member is slidably received within the outer member for longitudinal coaxial movement relative thereto. The outer member includes an elongate opening for receiving a fence post therethrough. When a fence post is received within the outer member beneath the inner member, downward force applied to the inner member along its longitudinal axis drives the fence post into the ground in a stable manner and in alignment with the axis of each member.

It is an object of the instant invention to provide a fence post driver which overcomes the above-enumerated disadvantages of past drivers.

It is a more specific object of the instant invention to provide a fence post driver which applies substantially all of its downward-driving force along the axis of the fence post.

It is another specific object of the invention to provide a fence post driver which includes structure for bracing and aligning a fence post along and around a substantial part thereof during the driving process.

These and other objects and advantages will become more fully apparent as the following detailed description of the invention is read in conjunction with the accompanying drawings wherein.

DETAILED DESCRIPTION OF THE INVENTION

Figure 1:
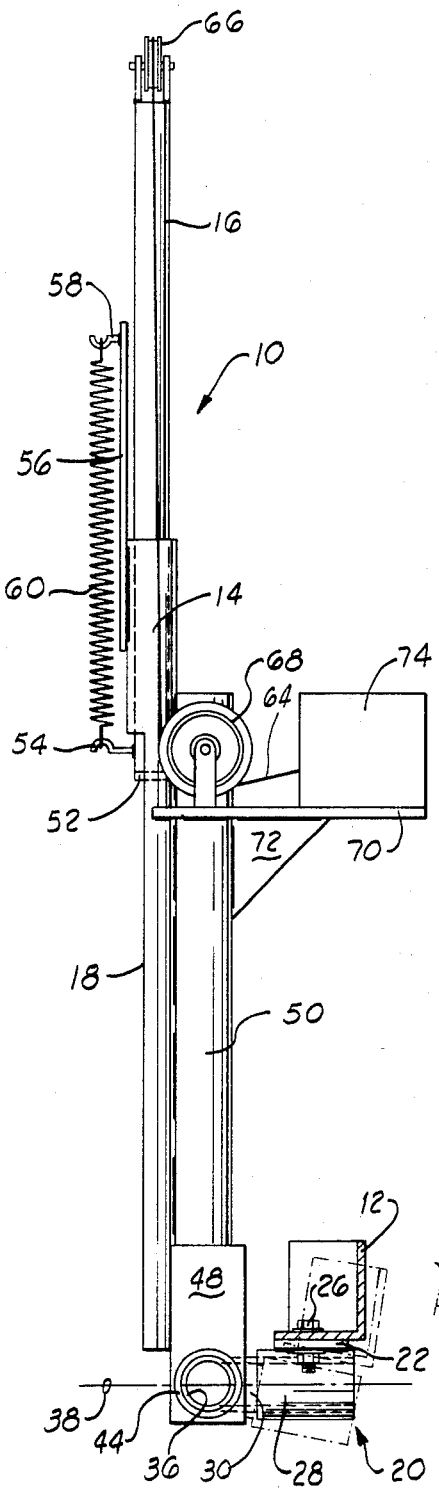
FIG. 1 is a side elevation view of the instant embodiment of the invention.

Indicated generally at 10 is a preferred embodiment of the instant fence post driver. The instant embodiment of the invention is adapted to be mounted on a rear bumper 12 (shown cross-sectionally in FIG. 1) of a pick-up truck (not shown). Speaking only generally in terms of the structure and operation of the instant fence post driver, a pipe 14, also referred to herein as a first or outer tubular member, has slidably received therein a pipe 16, also referred to herein as a second tubular member or inner cylindrical member. Pipe 14 includes an elongated opening 18 through which may be received a fence post. When pipe 16 is driven downwardly relative to pipe 14, the fence post is driven into the ground.

Examining in more detail the structure of fence post driver 10, attention is directed to the fence post driver mounting means, indicated generally at 20. Mounting means 20 includes a plate 22 which is bolted to bumper 12 via bolts 24, 26. A pipe section 28 is welded to the underside of plate 22 between bolts 24, 26. Pipe section 28 includes a threaded radially inner side (not visible) which is threadably engaged with a pipe section 30, such having a threaded radially outer side for facilitating such engagement. The opposite end of pipe section 30 is welded to a pipe section 32. Pipe section 32 includes a middle unthreaded portion 33, viewable in FIG. 2, and two end portions 34, 36, end portion 36 being viewable in FIG. 1. Each end portion 34, 36 has a radially outer threaded surface.

Figure 2:
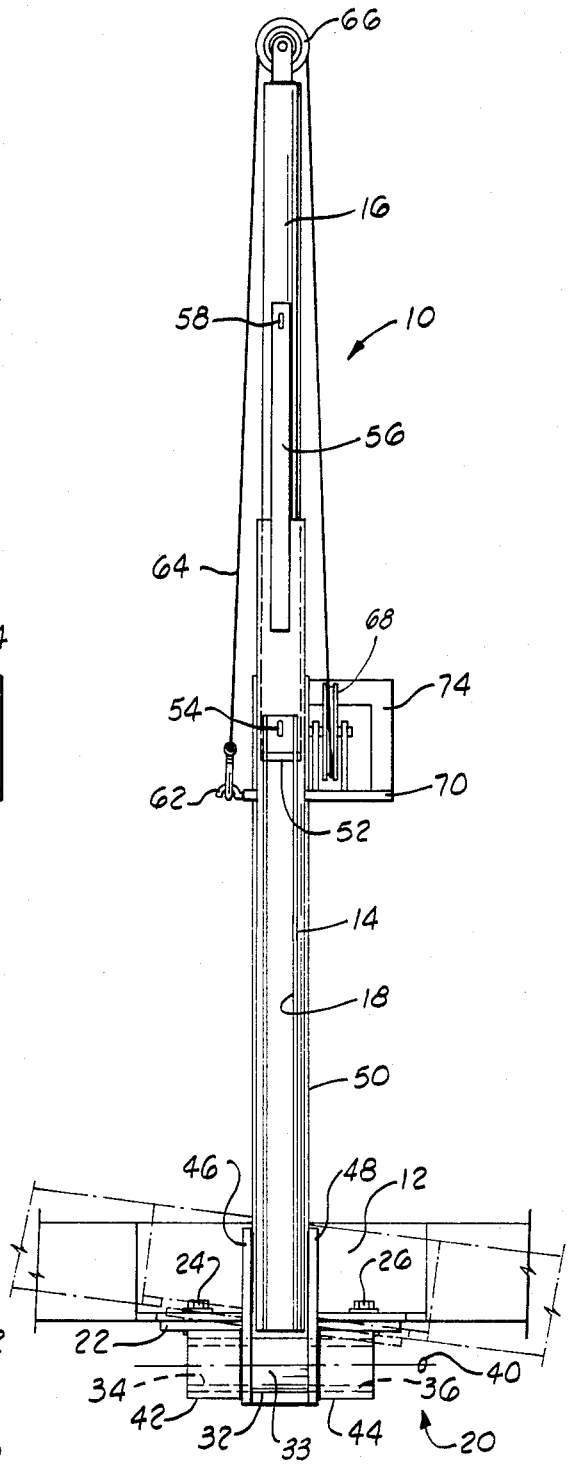
FIG. 2 is a front elevation view of the instant embodiment of the invention.

Axes 38, 40, in FIGS. 1 and 2, respectively, define the central axis of pipe sections 28, 32, respectively. Pipes 28, 32 are welded together substantially perpendicular to their respective axes.

Each end portion 34, 36 is threadably engaged with threads formed on the radially inner surfaces of pipe sections 42, 44, respectively. One end of pipe section 44 is viewable in FIG. 1, along with one end of pipe 36 which is threadably received within pipe 44. Each of pipe sections 42, 44 has one end welded to plates 46, 48, respectively, such being substantially parallel to one another. Each of the plates includes a hole (not visible) of a size sufficient to let pipe 33 pass therethrough without rubbing against the plate.

A pipe 50 is received between plates 46, 48 (and welded thereto on either side) and is welded at its lower end to middle section 33 of pipe 32 substantially perpendicular thereto. As can best be seen in FIG. 1, pipe 50 and pipe 18 are welded to one another along the side against which each abuts the other.

As has been previously mentioned, pipe 16 is slidably received within pipe 14. Pipe 16 includes a circular plug 52 which is welded to the bottom thereof. A hook 54 is welded to the side of pipe 16 above the lower end thereof. Pipe 14 has welded thereon a bracket 56, such having a hook 58 welded to the upper portion thereof. Biasing means or a spirng 60 (removed in the FIG. 2 view) has an end anchored by each hook and thus tends to bias pipe 16 upwardly relative to pipe 14.

Welded to the side of pipe 14 is a hook 62 (in FIG. 2). A cable 64 has one end anchored to hook 62 and extends upwardly over a pulley 66, such being rotatably mounted on the top of pipe 16. Cable 64 extends downwardly from a pulley 66 to a second pulley 68 which is mounted on a platform 70, such being welded to pipe 50 and supported by a brace 72 interposed between pipe 50 and the platform. The cable extends around pulley 68 and is received onto a drum (not visible) of a conventional winch 74 which is secured to platform 70.

In operation, fence post driver 10 is typically bolted to the lower side of pick-up bumper 12 as shown in the drawing. The rear gate of the pick-up truck is removed and the bed of the truck if filled with fence posts. A driver positions the truck so that it straddles and is aligned with a proposed fence line. An operator walks behind the truck at the rear or the side and may signal the driver when to stop in order to drive a fence post. When the truck is stopped, the operator may select a fence post (not shown) from the bed of the truck and insert it through opening 18 so that the post is received within pipe 14 beneath pipe 16.

The operator may then, if necessary, rotate pipe 14 (and hence the fence post) around axis 40 by pushing pipe 14 either frontward toward the truck or rearward away from the truck. Such rotation is achieved by the threaded engagement of end portions 34, 36 of pipe section 32 rotating within pipe sections 42, 44. In a similar manner, the operator may rotate pipe 14 from side to side about axis 38. Such rotation results from the threaded engagement of pipe section 30 within pipe section 28. The dot-dash line view of pipe section 28 and bumper 12 in FIG. 1 illustrates the rotation of pipe sections 28, 30 about axis 40 relative to the remainder of the fence post driver. The dot-dash line view in FIG. 2 illustrates the rotation of pipe 28 about axis 38 relative to the remainder of the fence post driver. By rotation about axes 38, 40 as described, the operator may orient pipe 14 (and hence the fence post received therein) so that each of the fence posts may be driven into the ground at any angle regardless of the terrain upon which the pick-up truck is sitting.

Once the fence post to be driven is received within pipe 14 and the pipe is selectively oriented as described above, the operator activates winch 74 to reel in cable 64 in a conventional manner. As cable is reeled in, pulleys 66, 68 rotate and pipe 16 is forced downwardly thus driving plug 52 against the top of the fence post and driving the bottom of the fence post into the ground. Such driving continues for so long as the winch is activated. When the post is driven into the ground to a desired depth, the winch is deactivated and inward reeling of cable 64 is stopped, thus stopping the driving of the fence post. Thereafter, the winch is activated to unwind cable thus paying cable out and rotating pulleys 66, 68 in the opposite direction from when cable is being wound onto the winch reel. When the cable is so paid out, spring 60 urges pipe 16 upwardly thus keeping cable 64 journaled over pulley 66 and moving pipe 16 upwardly as cable is paid out. When the pipe returns to its original position, the winch is again deactivated.

It should be noted that substantially all of the force generated by the winch is applied down the longitudinal axis of pipe 16 and is thus transferred to the top of a fence post received within pipe 14.

In one embodiment of the invention, one of the rear tires of the pick-up upon which the fence post driver is mounted may be marked near the outer portion of the tire. The operator may then follow the pick-up to the side of the marked tire thus observing the rotation and the mark. When the mark has gone through two rotations of the tire, the operator may signal the driver to stop the truck for driving the next fence post. If the tire circumference is typical, and if the operator counts off two tire revolutions between the driving of each fence post, a line of fence posts each being approximately fifteen feet from the other will result.

It is to be appreciated that additions and modifications may be made to the instant embodiment of the invention without departing from the spirit thereof which is defined in the following claims.

What is claimed is:

1. Apparatus for driving fence posts comprising:

a first pipe;

a second pipe, said first pipe being fixedly mounted on said second pipe with the longitudinal axis of said first pipe being substantially parallel and spaced apart from the longitudinal axis of said second pipe;

means for mounting the lower end of said second pipe on a vehicle, said second pipe assuming a generally upright position when so mounted;

a third pipe slidably received within said first pipe for coaxial longitudinal movement relative to said first pipe;

a post-driving structure formed on the lower end of said third pipe adapted for abutting against the top of a fence post;

a platform fixedly mounted on said second pipe adjacent its upper end, said platform being at a substantially right angle relative to the longitudinal axis of said second pipe;

a first pulley mounted on the top of said third pipe and having its rotational axis intersecting the axis of said third pipe substantially perpendicular thereto;

a second pulley mounted on said platform;

a winch mounted on said platform adjacent said second pulley; and a cable journaled over said first pulley and having one end fixedly attached to said first pipe, said cable further being journaled around said second pulley and having its other end wound onto said winch.

2. The apparatus of claim 1 wherein said first pipe includes an elongate opening for receiving a fence post therethrough.

3. The apparatus of claim 1 wherein said means for mounting the lower end of said second pipe on a vehicle comprises:

a fourth pipe fixedly mounted on the lower end of said second pipe and having its axis at a substantially right angle relative to the axis of said second pipe; and a fifth pipe threadably engaged with said fourth pipe for permitting relative rotational movement between said fourth and fifth pipes.

4. The apparatus of claim 3 wherein said means for mounting the lower end of said pipe on a vehicle further comprises:

a sixth pipe having one end fixedly mounted on said fifth pipe, the axis of said fifth pipe being at a substantially right angle to the axis of said sixth pipe; and a seventh pipe having one end in threaded engagement with said sixth pipe for permitting relative rotational movement between said sixth and seventh pipes, said seventh pipe further having its other end fixedly mounted on the vehicle.

5. A fence post driver comprising:

an outer pipe;

an inner pipe received within said outer pipe for longitudinal coaxial movement relative to said outer pipe;

an elongate opening formed in said outer pipe for receiving a fence post therethrough;

means for moving said inner pipe downwardly relative to said outer pipe;

means for biasing said inner pipe upwardly relative to said outer pipe, said biasing means comprising:

an elongate support fixedly mounted on said outer pipe adjacent its upper end, said support extending upwardly above said outer pipe and having its longitudinal axis substantially parallel and spaced apart from the longitudinal axis of said outer pipe;

a first hook mounted on said inner pipe adjacent its lower end, said first hook being below and extending out of said elongate opening;

a second hook mounted on said elongate support adjacent its upper end; and a spring having one end connected to said first hook and the other end connected to said second hook for biasing said inner pipe upwardly relative to said outer pipe.

6. The fence post driver of claim 5 wherein said moving means comprises:

a pulley mounted on the top of said inner pipe and having its rotational axis intersecting said inner pipe's axis substantially perpendicular thereto;

a cable journaled over said pulley and having one end fixedly attached to said outer pipe; and means for tensioning said cable.

7. The fence post driver of claim 6 wherein said cable tensioning means comprises a winch.

8. The fence post driver of claim 7 wherein said apparatus further includes a platform mounted on said outer pipe and wherein said winch is mounted on said platform, said apparatus further comprising:

a second pulley mounted on said platform and having said cable journaled thereover; and means for attaching said other cable end to said winch.

* * * * *

UNITED STATES PATENT AND TRADEMARK OFFICE

CERTIFICATE OF CORRECTION

PATENT NO. : 4,519,584

DATED : May 28, 1985

INVENTOR(S) : William R. McCray

It is certified that error appears in the above-identified patent and that said Letters Patent is hereby corrected as shown below:

Column 2, line 18, change "elongated" to --elongate--.

Column 2, line 62, change "spirng" to --spring--.

Column 3, line 10, change "if" to --is--.

Signed and Sealed this

*Thirteenth* Day of *August 1985*

[SEAL]

*Attest:*

DONALD J. QUIGG

*Attesting Officer* *Acting Commissioner of Patents and Trademarks*